US006534925B2

(12) United States Patent
Kawashima

(10) Patent No.: US 6,534,925 B2
(45) Date of Patent: Mar. 18, 2003

(54) ORGANIC ELECTROLUMINESCENCE DRIVING CIRCUIT, PASSIVE MATRIX ORGANIC ELECTROLUMINESCENCE DISPLAY DEVICE, AND ORGANIC ELECTROLUMINESCENCE DRIVING METHOD

(75) Inventor: Shingo Kawashima, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/026,849

(22) Filed: Dec. 27, 2001

(65) Prior Publication Data

US 2002/0101179 A1 Aug. 1, 2002

(30) Foreign Application Priority Data

Dec. 28, 2000 (JP) ..... 2000-403533

(51) Int. Cl.[7] ..... G09G 3/10

(52) U.S. Cl. ..... 315/169.1; 315/169.3; 313/582; 345/76

(58) Field of Search ..... 315/169.1, 169.3, 315/169.4; 313/281, 585; 345/72, 83, 55, 76

(56) References Cited

U.S. PATENT DOCUMENTS 4,225,807 A * 9/1980 Ise et al. ..... 315/169.3
4,914,353 A * 4/1990 Harada ..... 315/169.3
5,973,456 A * 10/1999 Osada et al. ..... 315/169.1

FOREIGN PATENT DOCUMENTS

JP 11-143429 5/1999

* cited by examiner

*Primary Examiner*—Don Wong
*Assistant Examiner*—Jimmy T. Vu
(74) *Attorney, Agent, or Firm*—McGinn & Gibb, PLLC

(57) ABSTRACT

An organic electroluminescence (EL) driving circuit and a passive matrix organic EL display device are provided which are capable of decreasing an amount of current required to cause the organic EL element on a scanning line being in a non-selected state to be reverse-biased. The organic EL driving circuit is made up of a plurality of driving sources to feed a driving current from a first power source to a data line to be selected at every scanning timing, a plurality of charging switches to connect all data lines to a voltage holding circuit at an initial stage of scanning timing, a voltage holding circuit to hold each of data lines at a fixed voltage and horizontal driving change-over switches placed on every scanning line in each row and operated to connect selected scanning lines to a ground or to a second power source and to perform switching so as to cause the scanning line being not selected to be in a high impedance state, all of which operate to drive a passive matrix organic EL display panel in which organic EL elements are arranged in row and column directions and in a form of a matrix.

19 Claims, 8 Drawing Sheets

ORGANIC ELECTROLUMINESCENCE DRIVING CIRCUIT, PASSIVE MATRIX ORGANIC ELECTROLUMINESCENCE DISPLAY DEVICE, AND ORGANIC ELECTROLUMINESCENCE DRIVING METHOD

BACKGROUND OF THE INVENTION

1. Field of the Invention

The present invention relates to an organic electroluminescence (EL) driving circuit and a passive matrix organic EL display device which can reduce power consumption occurring when a passive matrix organic EL display panel is operated.

The present application claims priority of Japanese Patent Application No. 2000-403533 filed on Dec. 28, 2000, which is hereby incorporated by reference.

2. Description of the Related Art

A passive matrix organic EL display panel is a display panel in which an organic EL element formed by stacking a thin film made up of an organic material and being a micro-light emitting unit containing no active element is placed on a substrate in a matrix form, requiring no backlight and now drawing the attention of people as a spontaneous light emitting type display device. The organic EL element, however, has a large problem. That is, since a parasitic capacity that a light emitting section has is structurally large at a time of a high-speed operation, a charging current of the organic EL element has to be reduced. To solve this problem, some technologies have been proposed (for example, in Japanese Laid-open Patent Application No. Hei 11-143429).

FIG. 6 is a diagram showing an example of configurations of a conventional passive matrix organic EL display device 100. FIG. 7 is a diagram showing a state of connection occurring at a time being different from a time shown in a case of the conventional passive matrix organic EL display device 100 in FIG. 6. FIG. 8 is a diagram showing another state of connection occurring at a time being different from the time shown in the case of the conventional passive matrix organic EL display device 100 in FIG. 6.

The conventional passive matrix organic EL display device 100, as shown in FIG. 6, chiefly includes a passive matrix organic EL display panel in which a plurality of organic EL elements E11, E12, E13, . . . , E1n, E21, E22, E23, . . . , E2n, E31, E32, E33, . . . , E3n, E41, E42, E43, . . . , E4n, . . . , Em1, Em2, Em3, . . . , and Emn is arranged in row and column direction and in a matrix form and in which one terminal of each of organic EL elements E11, E12, . . . , Emn is connected to each of a plurality of scanning lines R1, R2, R3, R4, . . . , and Rm for every row and another terminal of each of the organic EL elements E11, E12, . . . , Emn is connected to each of a plurality of data lines C1, C2, C3, . . . , and Cn for every column, horizontal driving change-over switches 11, 12, 13, 14, . . . , 1m placed on every scanning line R1, R2, . . . , Rm in each row, driving sources 21, 22, 23, . . . , 2n placed in every data line C1, C2, Cn in each column, charging switches 31, 32, 33, . . . , 3n placed in every data line C1, C2, . . . , Cn in each row, a voltage holding circuit 4 placed commonly on an output side of the charging switches 31, 32, 33, . . . , 3n in each column, a first power source 5 and a second power source 6.

The passive matrix organic EL display device 100 shown in FIG. 6 is constructed in a matter that organic EL elements E11, E12, . . . , Emn each corresponding to one of three primary colors made up of red (R), green (G), and blue (B) colors are formed in a form of a strip of paper and the organic EL elements E11, E12, . . . , Emn each having a number corresponding to each of the three primary colors are arranged in a same area and in a same arrangement order and a plurality of sets each including three organic EL elements E11, E12, . . . , Emn each having a different color is arranged on a same substrate so that they make up an pixel for displaying full colors. In the description below, to simplify the explanation, a passive matrix organic EL display panel to display only one color out of the three colors is described.

Each of the organic EL elements E11, E12, . . . , Emn is made up of a diode DE forming a light emitting section and its parasitic capacitor CE and an anode-side terminal of each of the organic EL elements E11, E12, . . . , Emn is connected to each of data lines C1, C2, . . . , Cn and a cathode-side terminal of each of the organic EL elements E11, E12, . . . , Emn is connected to each of scanning lines R1, R2, R3, . . . , and Rm.

The scanning line R1, R2, . . . , Rm in each row is sequentially selected for every scanning cycle and the data line C1, C2, . . . , Cn in each column is sequentially selected in every scanning cycle. Each of the horizontal driving change-over switches 11, 12, 13, 14, . . . , and 1m is, for example, a known semiconductor switch made up of a combination of a P (Positive)-type FET (Field Effect Transistor) and an N (Negative)-type FET, having "one-pole two-input" functions, that is, one port (pole) of the horizontal driving change-over switche 11, 12, . . . , 1m can be connected or switched sequentially to either of other two ports of the same horizontal driving change-over switch 11, 12, . . . , 1m and causes scanning lines R1, R2, . . . , Rm in each row to be connected to a ground when being selected and to be connected to a second power source 6 when being not connected. Each of the driving sources 21, 22, 23, . . . , and 2n feeds an amount of a current corresponding to luminous intensity of light to be emitted while being driven and does not feed the current while being not driven to the data lines C1, C2, . . . , Cn. Each of the charging switches 31, 32, 33, . . . , and 3n, in response to switching operation of the scanning line R1, R2, . . . , Rm on each row, connects a cathode-side terminal of each of the organic EL elements E11, E12, . . . , Emn, in parallel, to an anode-side of the voltage holding circuit 4. The voltage holding circuit 4 includes a constant-voltage element DH made up of a Zener diode (ZD) and parallel capacitor CH having electrostatic capacity being equivalent to a sum of all organic EL elements E11, E12, . . . , Emn making up the passive matrix organic EL display panel and is adapted to hold a voltage on the anode side of all organic EL elements E11, E12, . . . , Emn at a fixed electric potential VH determined by the constant-voltage element DH when each of the charging switches 31, 32, 33, . . . , and 3n is turned ON due to grounding of the cathode-side terminal. The first power source 5 applies a voltage V1 to each of driving sources. The second power source 6 applies a voltage V2 to each of horizontal driving change-over switches 11, 12, . . . , 1m.

Operations of the conventional passive matrix organic EL display device 100 will be described by referring to FIGS. 6, 7, and 8.

FIG. 6 shows a state in which the scanning operation is switched from a scanning line R1 in a first column to a scanning line R2 in a second column and the scanning line R2 is connected to a ground through the horizontal driving change-over switch 12. At this point, cathodes of all organic EL elements being connected to the selected scanning line R2 are connected to a ground. For example, when the data line C2 is in a driving state and when a driving current is fed from the first power source 5 through the driving source 22, in the organic EL element E22 being connected between the data line C2 and the scanning line R2 and now shown by being circled by a broken line, the fed driving current causes the diode DE to emit light with intensity corresponding to an amount of the fed driving current and also causes the parasitic capacitor CE to be charged.

Each of the organic EL elements being connected to the selected scanning line R2 and being connected to each of the data lines C1, C3, . . . , Cn but being not driven does not emit light, since each of corresponding driving sources 21, 23, . . . , 2n feeds the driving current to a degree which causes each of the organic EL elements to be a voltage level being less than a light emitting threshold value (hereinafter the voltage level being referred to as a "black level"). A voltage at which the organic EL element reaches the black level differs depending on a light emitting color. On the other hand, each of the organic El elements being connected to each of scanning lines R1, R2, . . . , Rm being not selected does not emit light since a voltage having a same polarity as that of the first power source 5 is applied from the second power source 6 to the cathode-side of each of the organic EL elements and therefore each of the organic EL elements is put into a reverse-biased state in which a reverse-directional voltage is applied to each of their diodes. At this point, the parasitic capacitor CE of each of the organic EL elements is charged so as to be in a state of the reverse biased potential.

FIG. 7 shows an initial state in which the scanning is performed on a scanning line R3 in a third column with subsequent timing, that is, in which each of the charging switches 31, 32, 33, . . . , and 3n is turned ON and the scanning line R2 is connected to the second power source 6 through the horizontal driving change-over switch 12 and the scanning line R3 is connected to a ground through the horizontal driving change-over switch 13. At this point, all the data lines C1, C2, C3, . . . , and 3n are connected each other through the charging switches 31, 32, 33, . . . , and 3n, which, as a result, are all connected to the anode-side of the voltage holding circuit 4. Then, an electric charge flows from the organic EL element which was driven and emitted light at the previous time and, as a result, all other organic EL elements are charged and voltages on their anode-side are held at the fixed electric potential VH determined and fixed by the voltage holding circuit 4. The fixed electric potential VH is a voltage at which the organic EL element with its cathode being connected to a ground reaches the black level, which causes all the organic EL elements being connected to the selected scanning line R3 to be pre-charged so as to be at the black level.

FIG. 8 shows a state in which each of the charging switches 31, 32, . . . , 3n is turned OFF and setting of the potential using the voltage holding circuit 4 has completed. At this point, all the data lines C1, C2, C3, . . . , and Cn are separated from each other and each of the data lines is separated from the voltage holding circuit 4. Moreover, since the scanning line R2 is connected to the second power source 6, the voltage on the cathode-side of the organic EL element E22 is raised to the level of the second power source 6 and, as a result, the organic EL element E22 is put into a reserve-biased state and its light goes off.

On the other hand, by the connection of the scanning line R3 newly selected to the ground, the driving current is fed from the driving line C2 to the organic EL element E32 existing on a next row and, as a result, the organic EL element E32 emits light with intensity corresponding to an amount of the fed driving current and the parasitic capacitor CE is charged. Moreover, the current at the black level flows through organic EL elements 31, E33, . . . , E3n being connected to the scanning line R3 newly selected but not being driven from the driving sources C1, C3, . . . , and Cn. At this point, since the parasitic capacitor CE of the organic EL element E32 has been charged so as to be at the black level determined by the voltage holding circuit 4 with the previous timing, an amount of electric charges to be applied before a start of light-emitting to the parasitic capacitor CE of the organic EL element E32 required at a time of being newly selected may be smaller, compared with a case in which a cathode of the organic EL element is connected to a ground at a time of being not selected, which enables emitting of light with high intensity in the organic EL element E32.

In the passive matrix organic EL element display device 100 shown in FIGS. 6, 7, and 8, since the organic EL element being connected on a newly selected scanning line and being driven has been already charged, with its previous timing, to a voltage of the charge holding circuit 4, an amount of the electric charge required before light is emitted is small and, therefore, there is an advantage in that high-speed light emitting is achieved.

However, the conventional passive matrix organic EL element display device 100 has a problem. That is, since the parasitic capacitors CE of the organic EL elements not being selected are all charged, at every time of switching of the scanning line, at a voltage being equivalent to a difference between a voltage of the second power source 6 and that of the voltage holding circuit 4 and, as a result, current consumption of the entire device increases, causing power source capacity to be larger.

SUMMARY OF THE INVENTION

In view of the above, it is an object of the present invention to provide an organic EL driving circuit and a passive matrix organic EL display device capable of reducing charging currents being produced at a time of switching of scanning lines and to be supplied to an organic EL element being connected to a scanning line being not selected.

According to a first aspect of the present invention there is provided an organic electroluminescence driving circuit for driving a passive matrix organic electroluminescence display panel in which a plurality of organic electroluminescence elements is arranged in row and column directions in a matrix form and in which one terminal of each of the organic electroluminescence elements is connected to each of a plurality of scanning lines in every row and another terminal of each of the organic electroluminescence elements is connected to each of a plurality of data lines in every column, the organic electroluminescence driving circuit including:

a plurality of driving sources each being placed on every data line in each column and each feeding a driving current from a first power source to a data line selected at every scanning timing, a plurality of charging switches each being placed on every data line in each column and each connecting all data lines to a voltage holding circuit at an initial stage of the scanning timing and releasing the connection at an end stage of the scanning timing, a voltage holding circuit to hold each of the connected data lines at a fixed voltage; and a plurality of horizontal driving change-over switches each being placed on every scanning line in each row and each connecting selected scanning lines at an initial stage of the scanning timing to a ground and, at the end stage of the scanning timing, each connecting the selected scanning line to a second power source and, in a subsequent scanning cycle and thereafter, each performing switching so as to cause the selected scanning line to be in a high impedance state until the scanning line is again selected next.

In the foregoing, a preferable mode is one wherein the fixed voltage held by the voltage holding circuit is a voltage corresponding to a black level of the organic electroluminescence element.

Also, a preferable mode is one wherein the voltage holding circuit is made up of a constant voltage element which holds the fixed voltage and an electrostatic capacitor which is connected in parallel to the constant voltage element.

Also, a preferable mode is one wherein the voltage holding circuit is made up of a constant voltage source which generates the fixed voltage.

According to a second aspect of the present invention, there is provided an organic electroluminescence driving circuit for driving a passive matrix organic electroluminescence display panel in which a plurality of organic electroluminescence elements is arranged in row and column directions and in a form of a matrix and in which one terminal of each of the organic electroluminescence elements is connected to each of a plurality of scanning lines in every row and another terminal of each of the organic electroluminescence elements is connected to each of a plurality of data lines in every column, the organic electroluminescence driving circuit including:

a plurality of driving sources each being placed on every data line in each column and each feeding a driving current from a first power source to the data line selected in every scanning cycle;

a plurality of charging switches each being placed on every data line in each column and each operating to connect all the data lines to a ground at an initial stage of the scanning cycle and releasing the connection at an end stage of the scanning cycle; and a plurality of horizontal driving change-over switches each being placed on every scanning line in each row and each operating to connect selected scanning lines at an initial stage of the scanning timing to a ground and to connect the selected scanning line to a second power source at an end stage of the scanning timing and, in a subsequent scanning cycle and thereafter, to perform switching so as to cause the selected scanning line to be in a high impedance state until the scanning line is again selected next.

In the foregoing, a preferable mode is one wherein the second power source has a voltage enough to cause all the organic electroluminescence elements being connected to the selected scanning line to be in a reverse-biased state.

Also, a preferable mode is one wherein the second power source has a same voltage as that of the first power source.

According to a third aspect of the present invention, there is provided a passive matrix organic electroluminescence display device including:

a passive matrix organic electroluminescence display panel in which a plurality of organic electroluminescence elements is arranged in row and column directions and in a matrix form and in which one terminal of each of the organic electroluminescence elements is connected to each of a plurality of scanning lines in every row and another terminal of each of the organic electroluminescence elements is connected to each of a plurality of data lines in every column, the organic electroluminescence driving circuit including:

a plurality of driving sources each being placed on every data line in each column and each feeding a driving current from a first power source to the data line selected in every scanning cycle;

a plurality of charging switches each being placed on every data line in each column and operating to connect all the data lines to a ground at an initial stage of scanning cycle and to release the connection at an end stage of the scanning cycle;

a voltage holding circuit to hold each of connected data lines at a fixed voltage;

a plurality of horizontal driving change-over switches each being placed on every scanning line in each row and each operating to connect selected scanning lines to a ground at an initial stage of the scanning timing and at an end stage of the scanning timing to connect the selected scanning line to a second power source at an end state of the scanning timing and, in a subsequent scanning cycle and thereafter, to perform switching so as to cause the selected scanning line to be in a high impedance state until the scanning line is again selected next.

In the foregoing, a preferable mode is one wherein the fixed voltage held by the voltage holding circuit is a voltage corresponding to a black level of the organic electroluminescence element.

Also, a preferable mode is one wherein the voltage holding circuit is made up of a constant voltage element to hold the fixed voltage and an electrostatic capacitor connected in parallel to the constant voltage element.

Also, a preferable mode is one wherein the voltage holding circuit is made up of a constant voltage source to generate the fixed voltage.

According to a fourth aspect of the present invention, there is provided a passive matrix organic electroluminescence display device including:

a passive matrix organic electroluminescence display panel in which a plurality of organic electroluminescence elements is arranged in row and column directions and in a matrix form and in which one terminal of each of the organic electroluminescence elements is connected to each of a plurality of scanning lines in every row and another terminal of each of the organic electroluminescence elements is connected to each of a plurality of data lines in every column;

a plurality of driving sources each being placed on every data line in each column and each feeding a driving current from a first power source to the data line selected in every scanning cycle;

a plurality of charging switches each being placed on every data line in each column and operating to connect all the data lines to a ground at an initial stage of the scanning cycle and to release the connection at an end stage of the scanning cycle; and a plurality of horizontal driving change-over switches each being placed on every scanning line in each row and operating to connect selected scanning lines to a ground at an initial stage of the scanning timing and to connect the selected scanning line to a second power source at an end stage of the scanning timing and, in a subsequent scanning cycle and thereafter, to perform switching so as to cause the selected scanning line to be in a high impedance state until the scanning line is again selected next.

In the foregoing, a preferable mode is one wherein the second power source has a voltage enough to cause all organic electroluminescence elements being connected to the selected scanning line to be put in a reverse-biased state at an end stage of the scanning timing.

Also, a preferable mode is one wherein the second power source has a same voltage as that of the first power source.

According to a fifth aspect of the present invention, there is provided a driving method of a passive matrix organic electroluminescence display panel in which a plurality of organic electroluminescence elements is arranged in row and column directions and in a matrix form and in which one terminal of each of the organic electroluminescence elements is connected to each of a plurality of scanning lines in every row and another terminal of each of the organic electroluminescence elements is connected to each of a plurality of data lines in every column, the display panel provided with a horizontal driving change-over switch on the scanning line in each row used to switch a state of selected scanning lines among a grounding state, high-voltage applying state, and high-impedance state the driving method including:

a step of, at an initial stage of scanning timing, connecting the selected scanning line to a ground and putting the organic electroluminescence element being connected to the scanning line into a state where it is able to be driven in the column direction;

a step of connecting, after end of a driving period, the selected scanning line to a high voltage applying power source and causing all the organic electroluminescence elements being connected to the scanning line to be put in a reverse-biased state;

a step of performing switching so as to cause the selected scanning line to be put into a high impedance state until the scanning line is again selected next, in a subsequent scanning cycle and thereafter.

With the above configurations, in the organic EL driving circuit and passive matrix organic EL display device, since the second power source is connected only to the scanning line which has just completed the scanning operation in order to cause the organic EL element to be reverse-biased and since the second power source is not connected to any other scanning line, an amount of the charging current being produced when the second power source is connected to the scanning line and flowing between the organic EL element and the voltage holding circuit becomes equal only to that of currents flowing through the parasitic capacitor of the organic EL element being connected to the selected scanning line. As a result, no unnecessary charging currents flow through the parasitic capacitor of all the organic EL elements being connected to the scanning line being already in the non-selected state and, therefore, it is possible to reduce current consumption largely compared with the conventional device adapted to cause all the scanning lines in a non-selected state to be reserve-biased, which enables a reduction of power consumption of the passive matrix organic EL display device and scaling-down of the display device.

Moreover, the horizontal driving change-over switch used to select the scanning line in the passive matrix organic electroluminescence display panel is so constructed to have the "one-pole three-input" function and, at an initial stage of scanning timing, the selected scanning line is connected to a ground and, at an end stage of the scanning timing, the selected scanning line is connected to the second power source. As a result, the scanning line being not selected is put into a floating state and, therefore, the power source used to cause the organic electroluminescence element to be reverse-biased is connected only to the scanning line which has just completed its scanning operation and other scanning lines are kept in an high-impedance state and an amount of the charging current being produced when the second power source is connected to the scanning line and flowing between the organic EL element and the voltage holding circuit becomes equal only to that of currents flowing through the parasitic capacitor of the organic EL element being connected to the selected scanning line. As a result, no unnecessary charging currents flow through the parasitic capacitor of all the organic EL elements being connected to the scanning line being already in the non-selected state and, therefore, it is also possible to reduce current consumption required to cause the organic EL element being not selected to be reverse-biased.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

Figure 1:
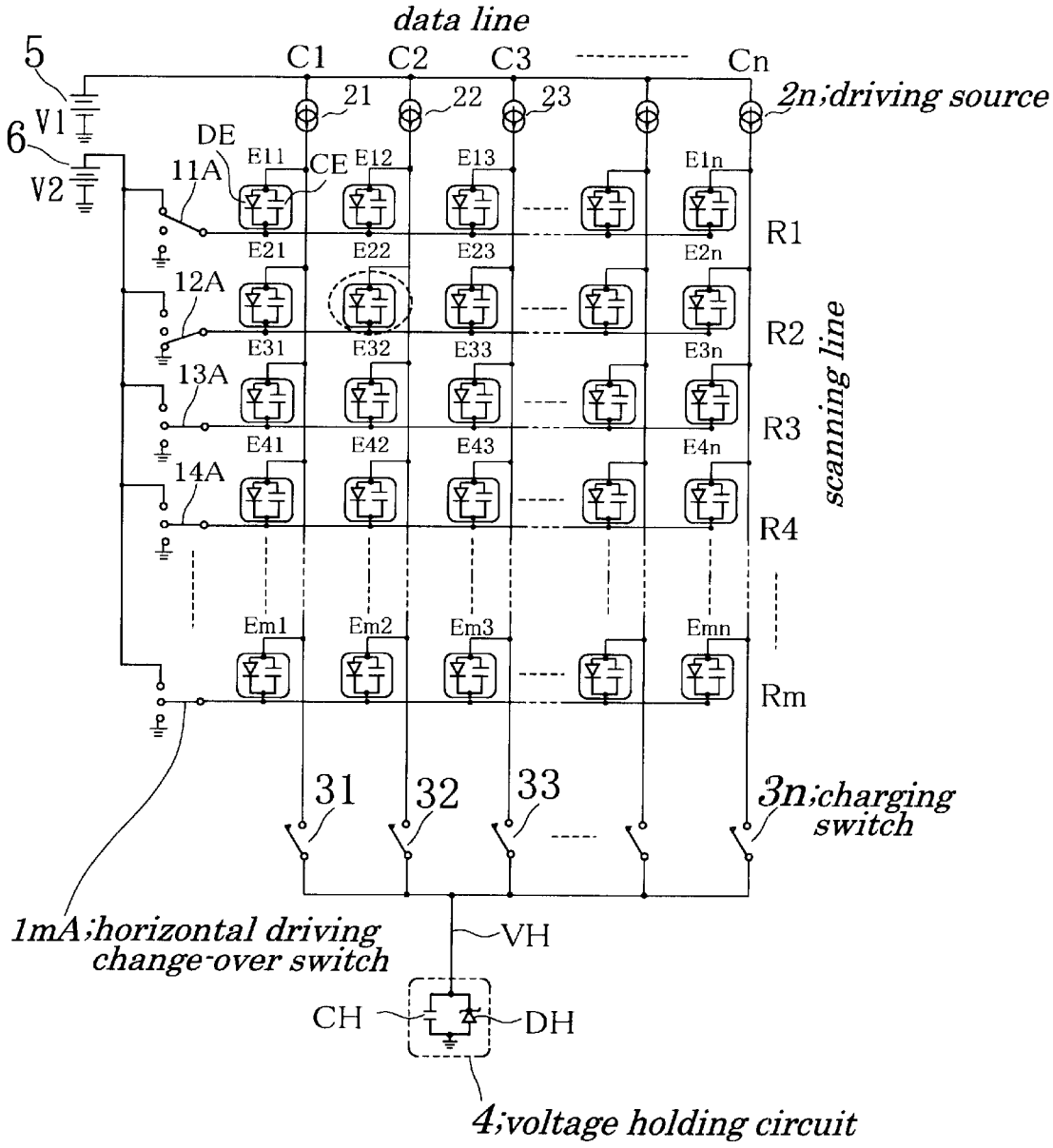
FIG. 1 is a diagram showing configurations of a passive matrix organic EL display device according to an embodiment of the present invention.
Figure 2:
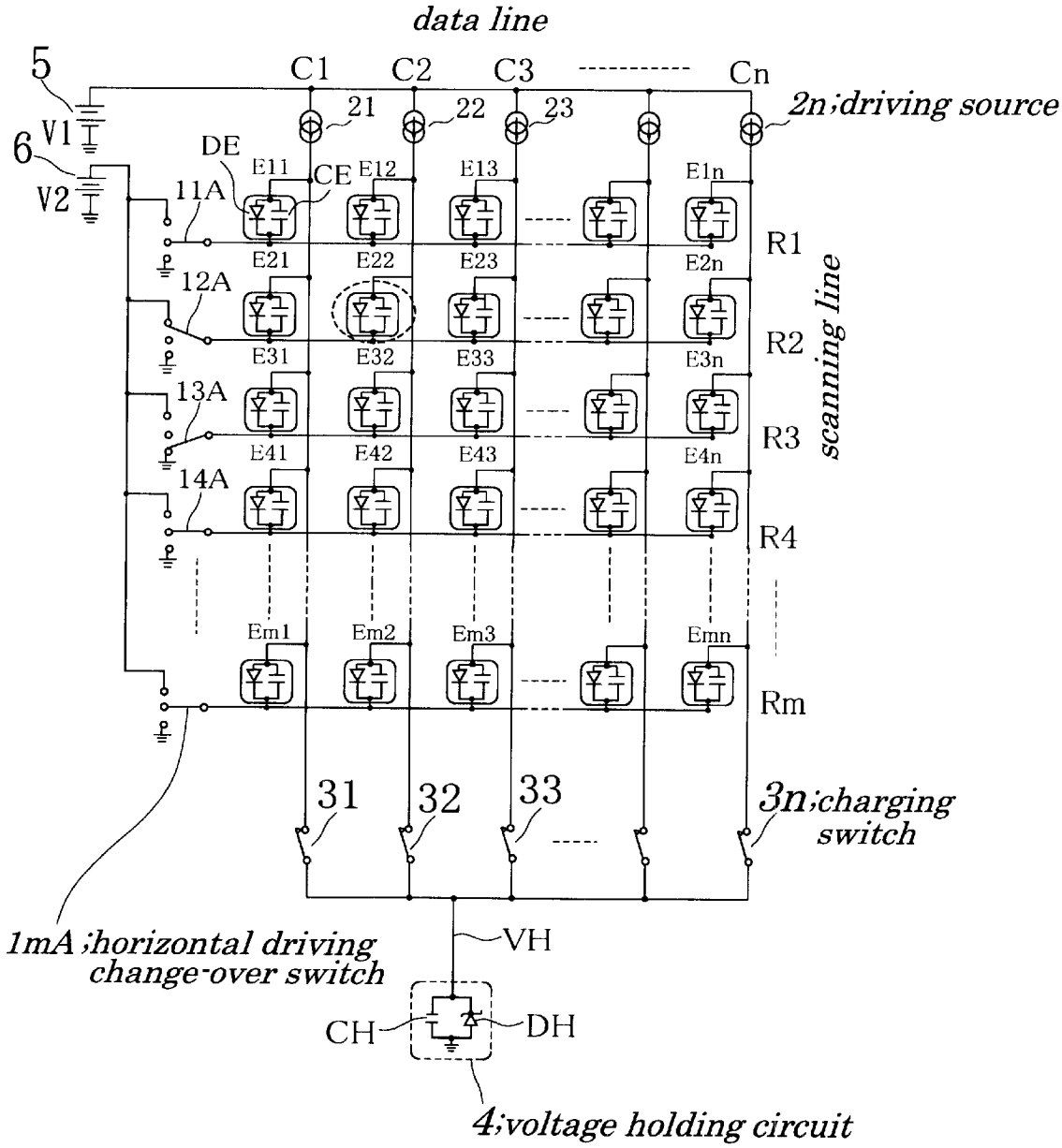
FIG. 2 is a diagram showing a state of connection occurring at a time being different from a time in a case of the passive matrix organic EL display device of FIG. 1.
Figure 3:
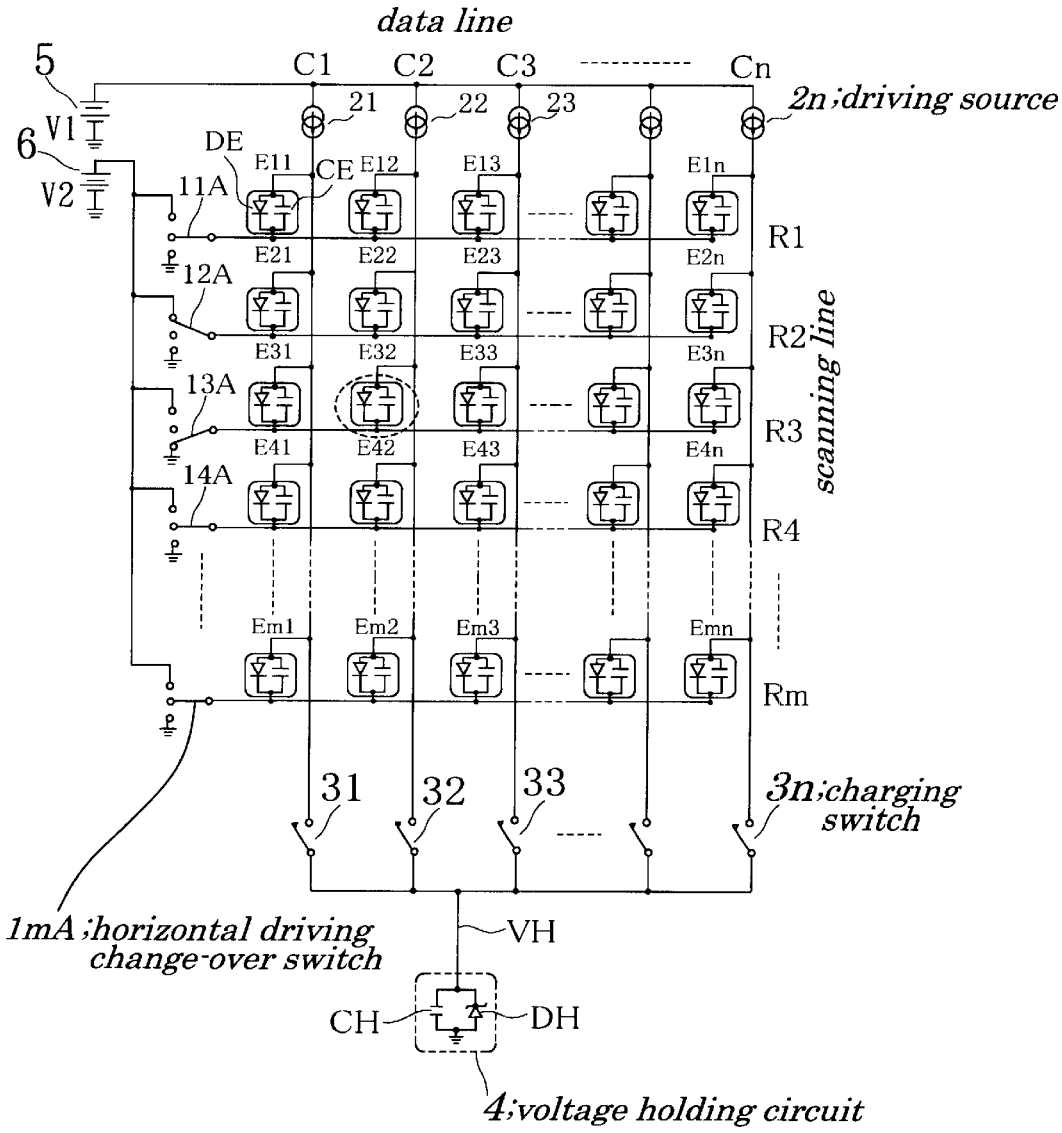
FIG. 3 is a diagram showing another state of connection occurring at a time being different from the time in the case of the passive matrix organic EL display device of FIG. 1.
Figure 4:
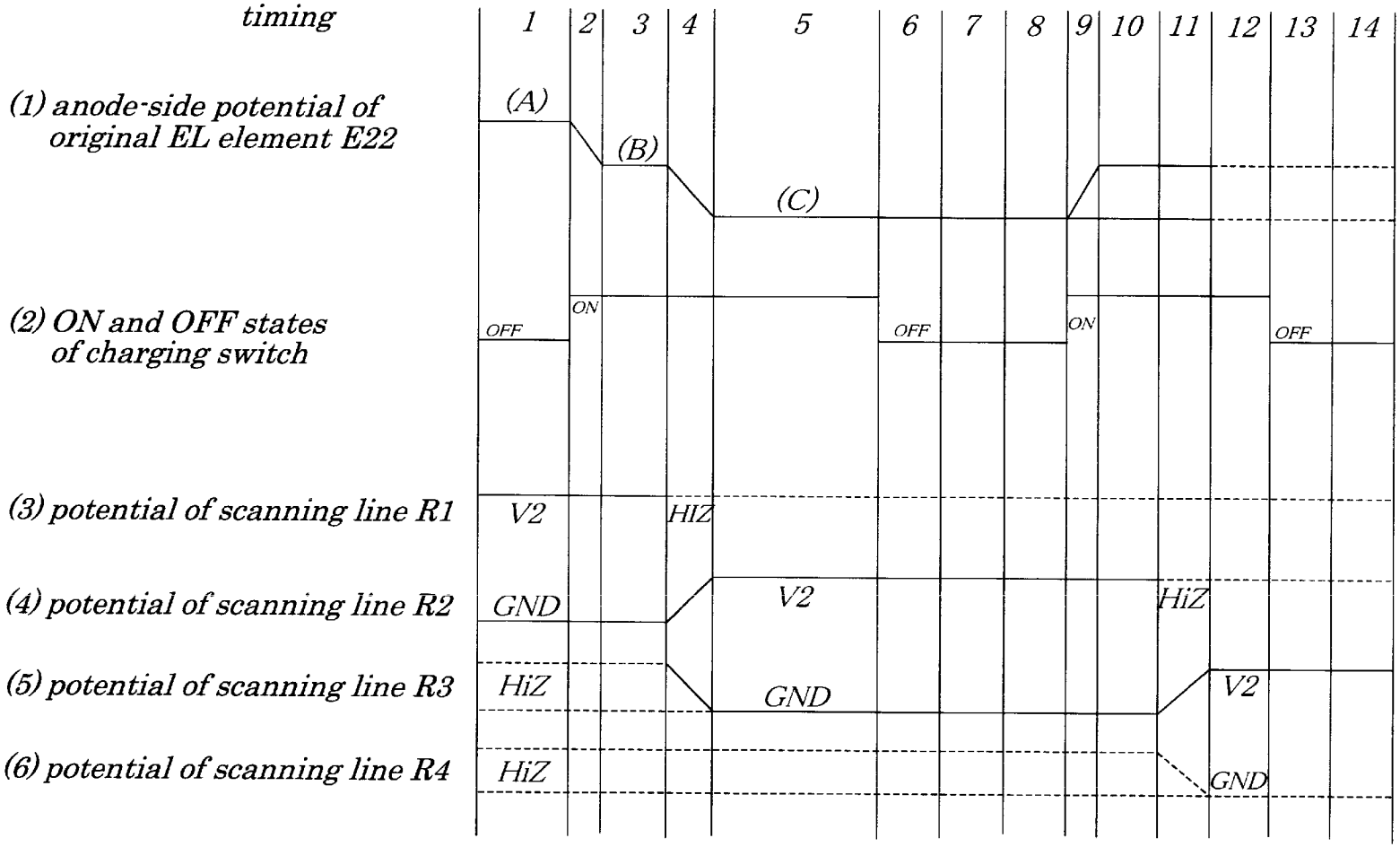
FIG. 4 is a timing chart explaining operations of the passive matrix organic EL display device according to the embodiment of the present invention.
Figure 5:
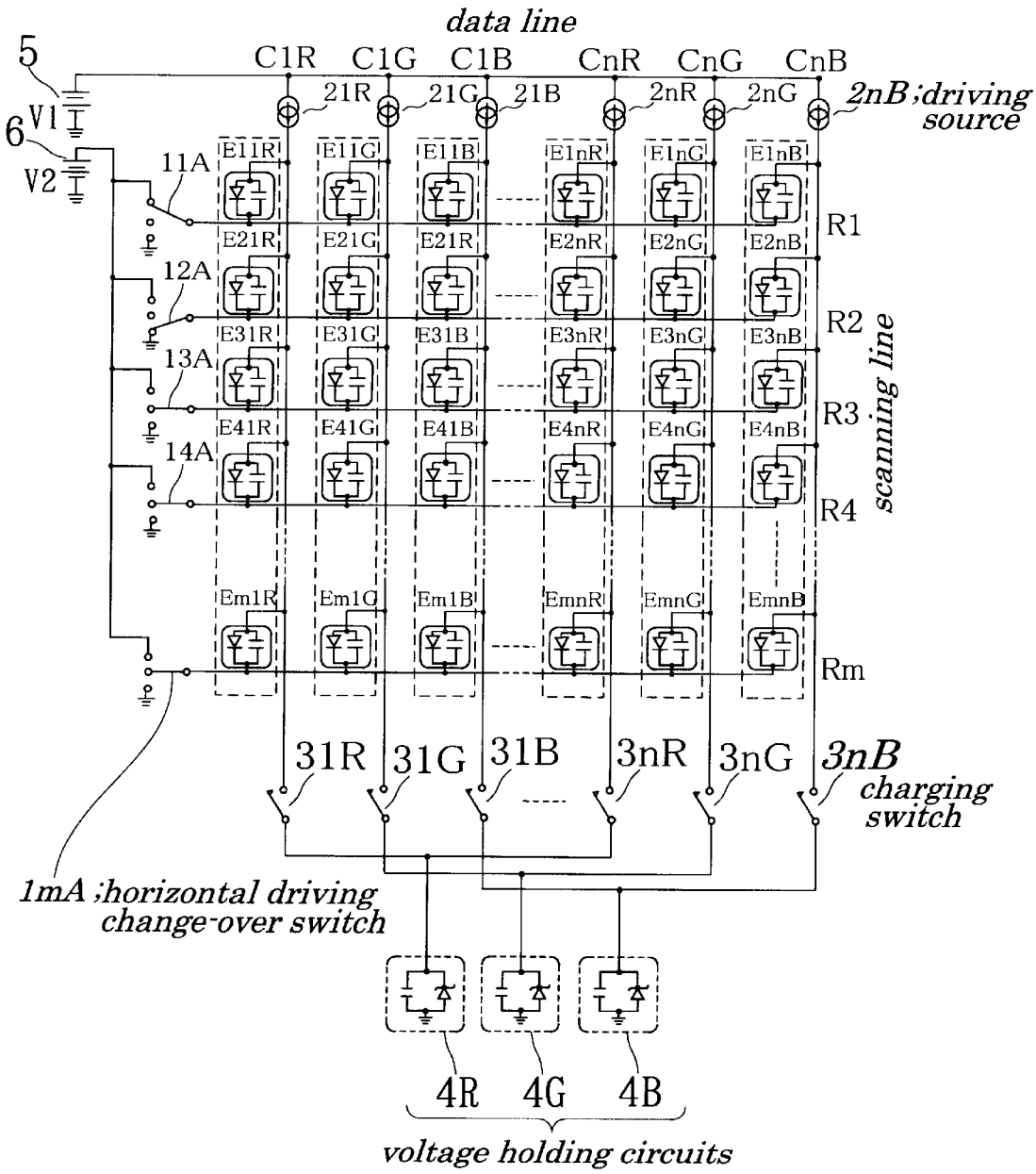
FIG. 5 is a diagram showing configurations of a full-color display type passive matrix organic EL display device according to the embodiment of the present invention.

FIG. 1. is a diagram showing configurations of a passive matrix organic EL display device according to an embodiment of the present invention. FIG. 2 is a diagram showing a state of connection occurring at a time being different from a time in a case of the passive matrix organic EL display device of FIG. 1. FIG. 3 is a diagram showing another state of connection occurring at a time being different from the time in the case of the passive matrix organic EL display device of FIG. 1. FIG. 4 is a timing chart explaining operations of the passive matrix organic EL display device according to the embodiment of the present invention. FIG. 5 is a diagram showing configurations of a color-display type passive matrix organic EL display device according to the embodiment of the present invention.

The passive matrix organic EL display device of the embodiment, as shown in FIG. 1, chiefly includes a passive matrix organic EL display panel in which a plurality of organic EL elements E11, E12, . . . , Emn are arranged in row and column directions and in a matrix form and in which one terminal of each of the organic EL elements E11, E12, . . . , Emn is connected to each of a plurality of scanning lines R1, R2, R4, . . . , and Rm for every row and another terminal of each of the organic EL elements E11, E12, . . . , Emn is connected to each of a plurality of data lines C1, C2, C3, . . . , Cn for every column, horizontal driving change-over switches 11A, 12A, 13A, 14A, . . . , 1mA placed in every scanning line R1, R2, . . . , Rm in each row, driving sources 21, 22, 23, . . . , 2n placed in every data line C1, C2, . . . , Cn in each column, charging switches 31, 32, 33, . . . , 3n placed in every data line C1, C2, . . . , Cn in each column, a voltage holding circuit 4 placed commonly on an output side of the charging switches 31, 32, 33, . . . , 3n in each column, a first power source 5 and a second power source 6.

Figure 6:
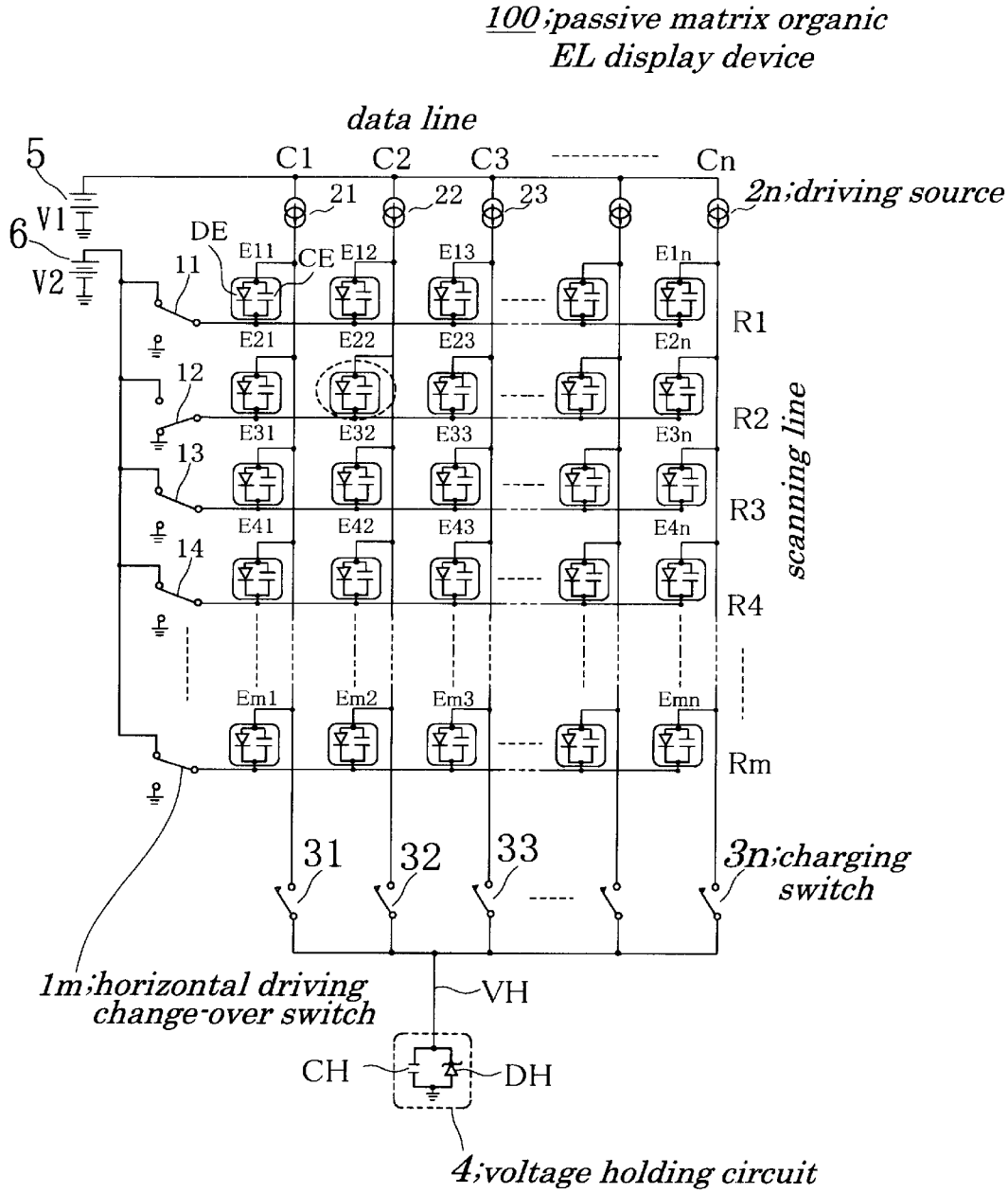
FIG.6 (PRIOR ART)
FIG. 6 is a diagram showing an example of configurations of a conventional passive matrix organic EL display device.

The passive matrix organic EL display device shown in FIG. 1 is constructed in a manner that, as in the conventional case shown in FIG. 6, organic EL elements E11, E12, . . . , Emn each corresponding to one of three primary colors made up of red (R), green (G), and blue (B) colors are formed in a shape of a strip of paper and the organic EL elements E11, E12, . . . , Emn each having a number corresponding to each of the three primary colors, red (R), green (G), and blue (B), are arranged on a plane and in a same arrangement order and a plurality of sets each including three organic EL elements E11, E12, . . . , Emn each having a different color is arranged on a same substrate so that they make up a pixel for displaying full colors. However, in the description below, to simplify explanation, a passive matrix organic EL display panel that displays only one color out of the three colors is described.

In the embodiment, configurations of a plurality of organic EL elements E11, E12, . . . , Emn, driving sources 21, 22, 23, . . . , 2n, charging switches 31, 32, 33, . . . , 3n, a voltage holding circuit 4, a first power source 5 and a second power source 6 are the same as those in the conventional example.

The scanning line R1, R2, . . . , Rm in each row is sequentially selected for every scanning cycle and the data line C1, C2, . . . , Cn in each column is sequentially selected in every scanning cycle. Each of the horizontal driving change-over switches 11A, 12A, 13A, . . . , and 1mA is, for example, a known semiconductor switch made up of a combination of a P-type FET and an N-type FET, having a "one-pole three input" function, that is, one port or a pole of the horizontal driving change-over switch 11A, 12A, . . . , 1mA can be connected or switched to any one of three ports in the same horizontal driving change-over switch 11A, 12A, . . . , 1mA and causes each of the scanning lines R1, R2, R3, R4, . . . , Rm to be connected to a ground while the organic EL element E11, E12, . . . , Emn emits light and to be connected to a second power source 6 at an end point of timing for switching the scanning line R1, R2, . . . , Rm in each row and further to be put into a high impedance state while being not driven.

Operations of the passive matrix organic EL display device of the embodiment will be explained by referring to FIGS. 1 to 4. Moreover, in FIG. 4, a number (1) shows an anode-side potential of the organic EL element E22, a number (2) shows ON and OFF states of the charging switch 31, 32, . . . , 3n and numbers (3), (4), (5), and (6) show potentials of the scanning lines R1, R2, R3, and R4, respectively.

FIG. 1 shows a state in which scanning operation is switched from a scanning line R1 in a first column to a scanning line R2 in a second column and the scanning line R2 is connected to a ground through the horizontal driving change-over switch 12A (see Timing 1 in FIG. 4).

At this point, cathodes of all the organic EL elements being connected to the selected scanning line R2 are connected to a ground. An anode of the organic EL element E22 being connected between the data line C2 and scanning line R2 and being shown by dotted lines, when the data line C2 is in a driving state and a driving current is fed from the first power source 5 through the driving source 22, is put, by the driving current, into a forward bias potential state as shown in (A) in FIG. 4, a diode DE emits light with intensity corresponding to an amount of the forward bias voltage and causes a parasitic capacitor CE to be charged.

Moreover, each of the organic EL elements being connected to the selected scanning line R2 but being not driven and being connected to each of the data lines C1, C3, . . . , Cn, since it is set in a manner that each of corresponding driving sources 21, 23, . . . , 2n feeds the driving current to a degree which causes each of the organic EL elements to be at a voltage level reaching the black level, and does not emit light.

On the other hand, since the second power source 6 is connected through each of the horizontal driving change-over switches 11A, 12A, 13A, 14A, . . . , 1mA to the scanning line R1 that was selected at the time of the previous scanning operation but has not been selected at this time of the scanning operation, each of the organic EL elements being connected to the scanning line R1 does not emit light, since it is put in a reverse biased state in which a reverse directional voltage is applied to a diode DE of the organic EL element by application of a voltage V2 having the same polarity as the first power source 5 to a cathode side of the organic EL element from the second power source 6. At this point, the parasitic capacitor CE of each of the organic EL elements is charged so as to be simultaneously a reverse-biased potential. Moreover, since each of the horizontal driving change-over switches 13A, 14A, . . . , 1mA corresponding to each of other scanning lines R3, R4, . . . , Rm being not selected is put into a high impedance (HiZ) state, each of the organic EL elements being connected to each of the scanning lines R3, R4, . . . , Rm does not emit light. Furthermore, the reverse-biased potential held in each of the parasitic capacitors CE, though being gradually changed by an influence of the driving potential of the organic EL element on the scanning line having been selected, is held at the reverse-biased level, however, the reverse-biased potential is still kept.

When the driving period for the scanning line R2 in the second column ends, all the charging switches 31, 32, . . . , 3n are turned ON and all the data lines C1, C2, C3, . . . , Cn are connected to the voltage holding circuit 4 (see Timing 2 in FIG. 4). As a result, the potential level of the anode-side terminals of all the organic EL elements containing the organic EL element E22, as shown in (B) in FIG. 4, reaches a electric potential VH of the black level determined by the voltage holding circuit 4, and then the organic EL element E22 is turned OFF and the light goes off (see Timing 3 in FIG. 4).

Figure 7:
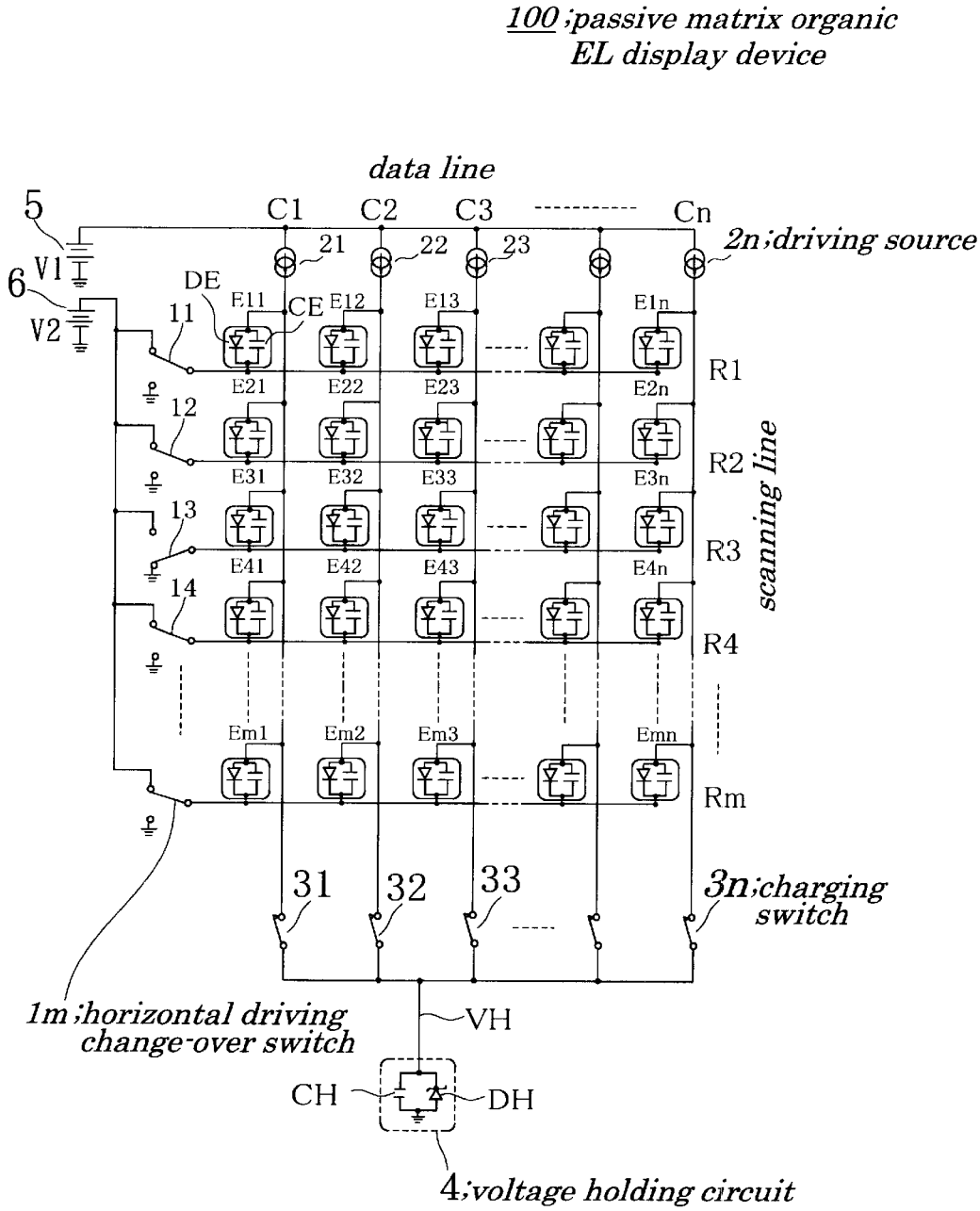
FIG. 7 (PRIOR ART)
FIG. 7 is a diagram showing a state of connection occurring at a time being different from a time in a case of the conventional passive matrix organic EL display device in FIG. 6.
Figure 8:
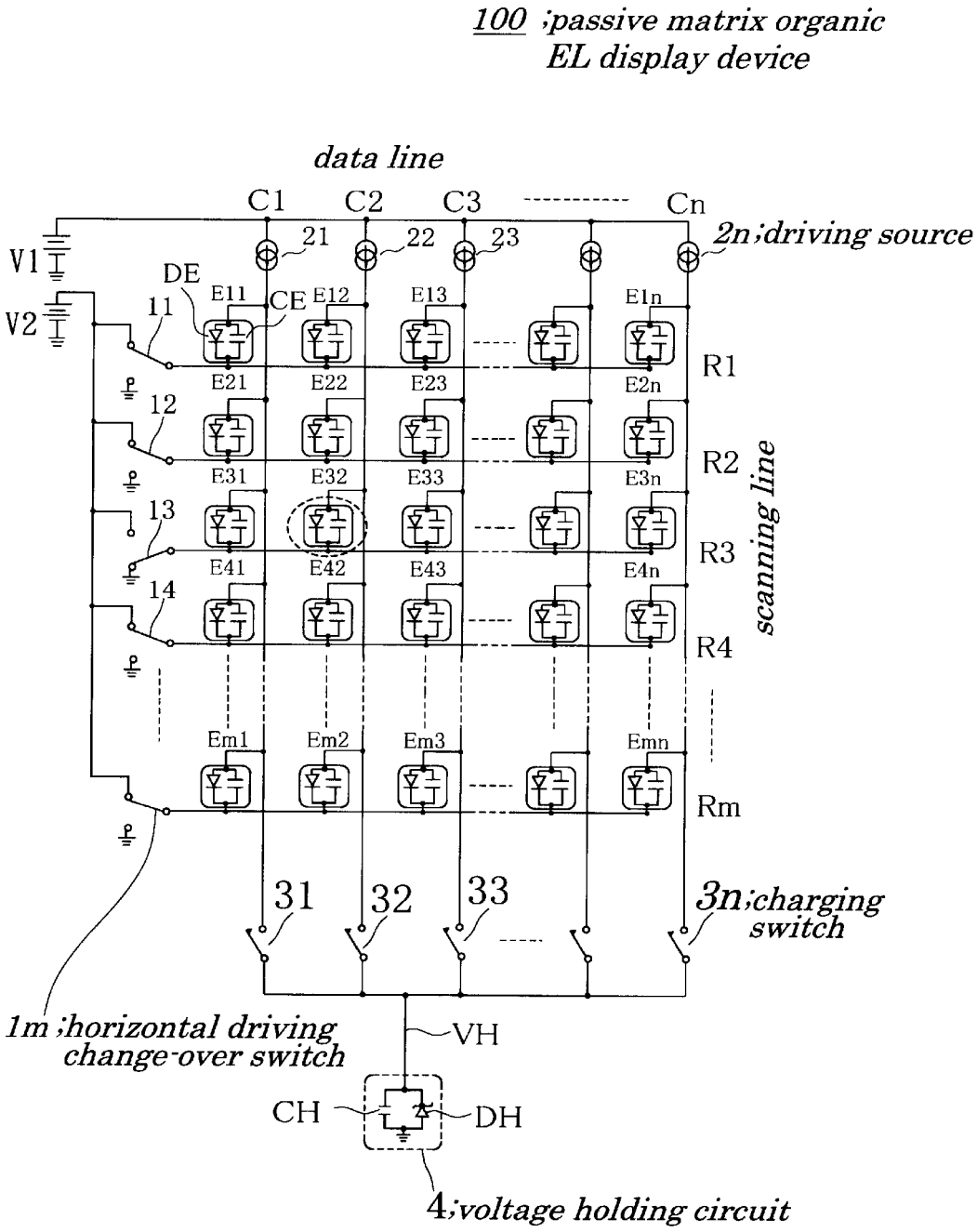
FIG.8 (PRIOR ART)
FIG. 8 is a diagram showing another state of connection occurring at a time being different from the time in the case of the conventional passive matrix organic EL display device in FIG. 6.

With subsequent timing, as shown in FIG. 2, the horizontal driving change-over switch 11A in the first column is switched to an OFF side, the horizontal driving change-over switch 12A in the scanning line R2 in the second column is switched to a side of a line of the second power source 6 and the horizontal driving change-over switch 13A of the scanning line R3 in the third column is switched to a side of a line of a ground (see Timing 4 in FIG. 4). At this point, when the horizontal driving change-over switch 11A is turned OFF, the scanning line R1, while the previous reverse-biased state is being still maintained, is put into a high-impedance (HiZ) state. Moreover, when the scanning line R2 is raised to the level of the potential V2 of the second power source 6 and when the reverse-biased potential is applied to the anode-side terminals of all the organic EL elements being connected to the scanning line R2 by the potential V2 of the second power source 6 and the electric potential VH of the voltage holding circuit 4, as shown in (C) in FIG. 4, and each of diodes DE of the organic EL elements is held in the reverse-biased state and the parasitic capacitor CE is charged. Moreover, when the scanning line R3 is connected to the ground, terminals on the cathode side of all the organic EL elements become a ground level, terminals on the anode side of the voltage holding circuit 4 are held at the electric potential VH and the organic EL elements are put in the black level state (see Timing 5 in FIG. 7).

Next, as shown in FIG. 3, when the charging switches 31, 32, 33, . . . , and 3n are turned OFF, a driving current is fed from the driving source 22 to the organic EL element E32 being driven and being connected to the scanning line R3 in the third column and light is emitted with brightness corresponding to an amount of the fed driving current (see Timing 6, 7, and 8).

With subsequent timing, since the charging switches 31, 32, 33, . . . , and 3n are turned ON and the horizontal driving change-over switch 12A on the scanning line R2 in the second column is switched to an OFF side (see Timing 9 in FIG. 4), light of the organic EL element E32 goes off. Moreover, since the potential of the horizontal driving change-over switch 13A on the scanning line R3 in the third column is changed to the potential V2 of the second power source 6 and terminals on the anode-side of the organic EL element being connected to the scanning line R3 are maintained at the reverse-biased potential and the horizontal change-over switch 14A in the fourth column is switched to a side of a ground (see Timing 11 in FIG. 4), the organic EL element E42 being connected to the data line C2 in the subsequent row is put in a light-emissive state.

Thus, in the passive matrix organic EL display panel of this embodiment, since the second power source 6 is connected only to the scanning line which has just completed the scanning operation in order to cause the organic EL element to be reverse-biased and not connected to any other scanning line, an amount of the charging current being produced when the second power source 6 is connected to the scanning line and flowing between the organic EL element and the voltage holding circuit 4 becomes equal only to that of currents flowing through the parasitic capacitor CE of the organic EL element being connected to the selected scanning line. As a result, no charging currents flow through the parasitic capacitors CE of all the organic EL elements being connected to the scanning line being already in the non-selected state and, therefore, it is possible to reduce current consumption required to cause the organic EL element being not selected to be reverse-biased.

The organic EL element being put in the high impedance state, if a dim screen is continuously provided by an influence of driving states of other organic EL elements in the passive matrix organic EL element display panel, maintains the state in which the reverse-biased potential is high. However, if a bright screen is provided frequently, since the charge is moved through the diode DE to the side of the first power source 5, the reverse-biased potential gradually becomes decreased. In FIG. 4, in the reserve-biased potential of the organic EL element E22 occurring after Timing (9), a line on a lower side indicates a case in which the dim screen is frequently provided while a line on an upper side indicates the case in which the bright screen is frequently provided. Similarly, in FIG. 4, both a potential of the scanning line R3 provided before Timing 4 and a potential of the scanning line R4 provided before Timing 11 are shown doubly by broken lines in which a line on a lower side indicates a case where the scanning line R3 is kept in a state of high impedance due to frequent occurrence of the dim screen and no change occurs in the reverse-biased potential and a line on an upper side indicates a case where the potential has become high due to the frequent occurrence of the bright screen.

Next, the full-color display type passive matrix organic EL display device to which the present invention is applied will be described by referring to FIG. 5.

The full-color display type passive matrix organic EL display device of the embodiment, as shown in FIG. 5, chiefly includes a passive matrix organic EL display panel in which a plurality of organic EL elements E1R, E1G, E1B, . . . , E1nR, E1nG, E1nB, E21R, E21G, E21B, . . . , E2nR, E2nG, E2nB, E31R, E31G, E31G, . . . E3nR, E3nG, E3nB, E41R, E41G, E41B, . . . , E4nR, E4nG, E4nB, . . . , Em1R, Em1G, Em1B, . . . , EmnR, EmnG, EmnB is arranged in row and column directions and in a matrix form and in which one terminal of each of organic EL elements E1R, E1G, E1B, . . . , EmnR, EmnG, EmnB is connected to each of a plurality of scanning lines R1, R2, R4, . . . , and Rm for every row and another terminal of each of the organic EL elements E1R, E1G, E1B, . . . , EmnR, EmnG, EmnB is connected to each of a plurality of data lines C1R, C1G, C1B, . . . , CnR, CnG, and CnB for every column, horizontal driving change-over switches 11A, 12A, 13A, 14A, . . . , 1mA placed in every scanning line R1, R2, . . . Rm in each row, driving sources 21R, 21G, 21B, . . . , 2nR, 2nG, and 2nB placed in every data line C1R, C1G, C1B, . . . , CnR, CnG, and CnB in each column, charging switches 31R, 31G, 31B, . . . 3nR, 3nG, and 3nB placed in every data line C1R, C1G, C1B, . . . , CnR, CnG, and CnB in each column, voltage holding circuits 4R, 4G and 4B placed commonly on an output side of the charging switches 31R, 31G, 31B, . . . , 3nR, 3nG, 3nB in each column, a first power source 5 and a second power source 6. Out of them, configurations of the horizontal driving change-over switches 11A, 12A, 13A, 14A, . . . , and 1mA, and the first power source 5, and second power source 6 are the same as those in the embodiment shown in FIG. 1.

Each of the organic EL elements E11R, E1G, E11B, . . . , EmnR, EmnG, EmnB each being made up, respectively, of an organic EL element for emitting red-color light with a letter "R" attached to a tail of its reference number, organic EL element for emitting green-color light with a letter "G" attached to a tail of its reference number and an organic EL element for emitting blue-color light with a letter "B" attached to a tail of its reference number and being arranged, for example, in order of R, G, and B colors, repeatedly on the scanning line in a same row and being arranged in a manner that the organic EL elements each having a same color are placed on the data line in a same column, makes up the passive matrix organic EL display panel. Thus, three organic EL elements being adjacent to each other on the same scanning line in the same row constitutes one pixel and each of the three organic EL elements emits light in response to a color component driving current corresponding to a color to be displayed, thereby enabling a full-color display. The three organic EL elements makes up a square color pixel whose side is 300 μm being constructed in a manner that it has a form of paper, for example, 100 μm by 300 μm and that the three organic EL elements are arranged in a same order in one plane.

Each of the driving sources 21R, 21G, 21B, . . . , 2nR, 2nG, 2nB each being made up of, respectively, a driving source to be used for emitting red light with a letter "R" attached to a tail of its reference number, a driving source to be used for emitting green light with a letter "G" attached to a tail of its reference number and a driving source to be used for emitting blue light with a letter "B" attached to a tail of its reference number, is adapted to provide an amount of the driving current responding to a component of a color to be displayed to red-color display data lines C1R, . . . , CnR, green-color display data lines C1G, CnG and blue-color display data lines C1B, . . . , CnB. Each of charging switches 31R, . . . , 3nR, 31G, . . . , 3nG, 31B, . . . , 3nB is adapted to connect, at a time of pre-charging, red-color displaying data lines 21R, . . . , 3nR, green-color displaying data lines 31G, . . . , 3nG, and blue-color displaying data lines 31B, . . . , 3nB to voltage holding circuits 4R, 4G, and 4B each being placed to correspond to each of the colors. Each of voltage holding circuits 4R, 4G, and 4B is adapted to set connected data line to the black level in response to a corresponding charging switch. The black level of the organic EL element differs, generally, depending on a color to be displayed, however, it may be at a same voltage.

Operations of the passive matrix organic EL display device for every color in the full-color passive matrix organic EL display device shown in FIG. 5 are the same as those in the embodiment in FIG. 1, however, by configuring the passive matrix organic EL display device as shown in FIG. 5 and by supplying a corresponding amount of the driving current according to a characteristic of the organic EL element of each color and by giving a voltage at an appropriate black level for every color to be displayed at a time of pre-charging from the voltage holding circuit, the passive matrix organic EL display device is operated in the same manner as for the single color passive matrix organic EL display device shown in FIG. 4 and, as a result, full-color display is enabled.

It is apparent that the present invention is not limited to the above embodiments but may be changed and modified without departing from the scope and spirit of the invention. For example, the voltage V2 of the second power source 6 may be the same as the voltage V1 of the first power source 5. Moreover, in the above embodiment, the voltage holding circuits 4, 4R, 4G and 4B are adapted to hold the voltage of the black level by using the constant voltage element and parallel capacitors, however, the present invention is not limited to this, that is, a constant voltage source that can produce a predetermined voltage corresponding to the black level of the organic EL element may be used. In this case, the constant voltage source that can supply and absorb the current while holding a fixed voltage depending on a state of loading has to be used, thereby holding the voltage at the black level, irrespective of an amount of electric charges. Also, by omitting the voltage holding circuits 4, 4R, 4G and 4B, terminals of the organic EL elements on the output side to the voltage holding circuit of each of the charging switches may be directly grounded.

In this case, charging currents required to cause each of the organic EL elements being connected to a scanning line which is also connected through the horizontal driving change-over switch to the second power source 6 to be reverse-biased increase more, when compared with a case in which there is the voltage holding circuit, however, since the charging current does not occur from the second power source 6 in each of the organic EL elements being connected to the scanning line in a high-impedance state, as in the case of the above embodiment, currents consumed to cause each of the organic EL elements to be put in a reverse-biased state, can be greatly reduced in the entire passive matrix organic EL display panel.

What is claimed is:

1. An organic electroluminescence driving circuit for driving a passive matrix organic electroluminescence display panel in which a plurality of organic electroluminescence elements is arranged in row and column directions in a matrix form and in which one terminal of each of said organic electroluminescence elements is connected to each of a plurality of scanning lines in every row and another terminal of each of said organic electroluminescence elements is connected to each of a plurality of data lines in every column, said organic electroluminescence driving circuit comprising:

a plurality of driving sources each being placed on every said data line in each said column and each feeding a driving current from a first power source to a data line selected at every scanning timing, a plurality of charging switches each being placed on every said data line in each said column and each connecting all said data lines to a voltage holding circuit at an initial stage of said scanning timing and releasing the connection at an end stage of said scanning timing, a voltage holding circuit to hold each of connected said data lines at a fixed voltage; and a plurality of horizontal driving change-over switches each being placed on every scanning line in each said row and each connecting selected said scanning lines at an initial stage of said scanning timing to a ground and, at said end stage of said scanning timing, each connecting said selected scanning line to a second power source and, in a subsequent scanning cycle and thereafter, each performing switching so as to cause said selected scanning line to be in a high impedance state until said scanning line is again selected next.

2. The organic electroluminescence driving circuit according to claim 1, wherein said fixed voltage held by said voltage holding circuit is a voltage corresponding to a black level of said organic electroluminescence element.

3. The organic electroluminescence driving circuit according to claim 1, wherein said voltage holding circuit is made up of a constant voltage element which holds said fixed voltage and an electrostatic capacitor which is connected in parallel to said constant voltage element.

4. The organic electroluminescence driving circuit according to claim 1, wherein said voltage holding circuit is made up of a constant voltage source which generates said fixed voltage.

5. The organic electroluminescence driving circuit according to claim 1, wherein said second power source has a voltage enough to cause all said organic electroluminescence elements being connected to said selected scanning line to be in a reverse-biased state.

6. The organic electroluminescence driving circuit according to claim 1, wherein said second power source has a same voltage as that of said first power source.

7. An organic electroluminescence driving circuit for driving a passive matrix organic electroluminescence display panel in which a plurality of organic electroluminescence elements is arranged in row and column directions and in a form of a matrix and in which one terminal of each of said organic electroluminescence elements is connected to each of a plurality of scanning lines in every row and another terminal of each of said organic electroluminescence elements is connected to each of a plurality of data lines in every column, said organic electroluminescence driving circuit comprising:

a plurality of driving sources each being placed on every said data line in each said column and each feeding a driving current from a first power source to said data line selected in every scanning cycle;

a plurality of charging switches each being placed on every said data line in each said column and each operating to connect all said data lines to a ground at an initial stage of said scanning cycle and releasing said connection at an end stage of said scanning cycle; and a plurality of horizontal driving change-over switches each being placed on every said scanning line in each said row and each operating to connect selected said scanning lines at an initial stage of said scanning timing to a ground and to connect said selected scanning line to a second power source at an end stage of said scanning timing and, in a subsequent scanning cycle and thereafter, to perform switching so as to cause said selected scanning line to be in a high impedance state until said scanning line is again selected next.

8. The organic electroluminescence driving circuit according to claim 7, wherein said second power source has a voltage enough to cause all said organic electroluminescence elements being connected to said selected scanning line to be in a reverse-biased state.

9. The organic electroluminescence driving circuit according to claim 7, wherein said second power source has a same voltage as that of said first power source.

10. A passive matrix organic electroluminescence display device comprising:

a passive matrix organic electroluminescence display panel in which a plurality of organic electroluminescence elements is arranged in row and column directions and in a matrix form and in which one terminal of each of said organic electroluminescence elements is connected to each of a plurality of scanning lines in every row and another terminal of each of said organic electroluminescence elements is connected to each of a plurality of data lines in every column, said organic electroluminescence driving circuit comprising:

a plurality of driving sources each being placed on every said data line in each said column and each feeding a driving current from a first power source to said data line selected in every scanning cycle;

a plurality of charging switches each being placed on every said data line in each said column and operating to connect all said data lines to a ground at an initial stage of scanning cycle and to release said connection at an end stage of said scanning cycle;

a voltage holding circuit to hold each of connected said data lines at a fixed voltage;

a plurality of horizontal driving change-over switches each being placed on every said scanning line in each said row and each operating to connect selected said scanning lines to a ground at an initial stage of said scanning timing and at an end stage of said scanning timing to connect said selected scanning line to a second power source at an end state of said scanning timing and, in a subsequent scanning cycle and thereafter, to perform switching so as to cause said selected scanning line to be in a high impedance state until said scanning line is again selected next.

11. The passive matrix organic electroluminescence display device according to claim 10, wherein said fixed voltage held by said voltage holding circuit is a voltage corresponding to a black level of said organic electroluminescence element.

12. The passive matrix organic electroluminescence display device according to claim 10, wherein said voltage holding circuit is made up of a constant voltage element to hold said fixed voltage and an electrostatic capacitor connected in parallel to said constant voltage element.

13. The passive matrix organic electroluminescence display device according to claim 10, wherein said voltage holding circuit is made up of a constant voltage source to generate said fixed voltage.

14. The passive matrix organic electroluminescence display device according to claim 10, wherein said second power source has a voltage enough to cause all said organic electroluminescence elements being connected to said selected scanning line to be put in a reverse-biased state at said end stage of said scanning timing.

15. The passive matrix organic electroluminescence display device according to claim 10, wherein said second power source has a same voltage as that of said first power source.

16. A passive matrix organic electroluminescence display device comprising:

a passive matrix organic electroluminescence display panel in which a plurality of organic electroluminescence elements is arranged in row and column directions and in a matrix form and in which one terminal of each of said organic electroluminescence elements is connected to each of a plurality of scanning lines in every row and another terminal of each of said organic electroluminescence elements is connected to each of a plurality of data lines in every column;

a plurality of driving sources each being placed on every said data line in each said column and each feeding a driving current from a first power source to said data line selected in every scanning cycle;

a plurality of charging switches each being placed on every said data line in each said column and operating to connect all the data lines to a ground at an initial stage of said scanning cycle and to release said connection at an end stage of said scanning cycle; and a plurality of horizontal driving change-over switches each being placed on every said scanning line in each said row and operating to connect selected said scanning lines to a ground at an initial stage of said scanning timing and to connect said selected scanning line to a second power source at an end stage of said scanning timing and, in a subsequent scanning cycle and thereafter, to perform switching so as to cause said selected scanning line to be in a high impedance state until said scanning line is again selected next.

17. The passive matrix organic electroluminescence display device according to claim 16, wherein said second power source has a voltage enough to cause all said organic electroluminescence elements being connected to said selected scanning line to be put in a reverse-biased state at said end stage of said scanning timing.

18. The passive matrix organic electroluminescence display device according to claim 16, wherein said second power source has a same voltage as that of said first power source.

19. A driving method of a passive matrix organic electroluminescence display panel in which a plurality of organic electroluminescence elements is arranged in row and column directions and in a matrix form and in which one terminal of each of said organic electroluminescence elements is connected to each of a plurality of scanning lines in every row and another terminal of each of said organic electroluminescence elements is connected to each of a plurality of data lines in every column, said display panel provided with a horizontal driving change-over switch on said scanning line in each said row used to switch a state of selected scanning lines among a grounding state, high-voltage applying state, and high-impedance state, said driving method comprising:

a step of, at an intial stage of scanning timing, connecting said selected scanning line to a ground and putting said organic electroluminescence element being connected to said scanning line into a state where it is able to be driven in said column direction;

a step of connecting, after end of a driving period, said selected scanning line to a high voltage applying power source and causing all said organic electroluminescence elements being connected to said scanning line to be put in a reverse-biased state;

a step of performing switching so as to cause said selected scanning line to be put into a high impedance state until said scanning line is again selected next, in a subsequent scanning cycle and thereafter.

* * * * *